US008763636B2

(12) United States Patent
Buckley et al.

(10) Patent No.: US 8,763,636 B2
(45) Date of Patent: Jul. 1, 2014

(54) VALVE ASSEMBLY FOR FUEL PUMP

(75) Inventors: Paul Buckley, Gillingham (GB); Antonin Cheron, Bexleyheath (GB); Kevin J. Laity, Bearsted (GB)

(73) Assignee: Delphi International Operations Luxembourg S.a.r.l., Luxembourg (LU)

( * ) Notice: Subject to any disclaimer, the term of this patent is extended or adjusted under 35 U.S.C. 154(b) by 1254 days.

(21) Appl. No.: 12/567,997

(22) Filed: Sep. 28, 2009

(65) Prior Publication Data

US 2010/0119395 A1 May 13, 2010

(30) Foreign Application Priority Data

Nov. 7, 2008 (EP) ..... 08168619

(51) Int. Cl.
*F16K 15/06* (2006.01)

(52) U.S. Cl.
USPC ..... 137/540; 137/512.3; 417/559; 251/337

(58) Field of Classification Search
USPC ..... 137/512.3, 539, 540, 543.17; 251/322, 251/323, 337; 267/166, 166.1; 417/559
See application file for complete search history.

(56) References Cited

U.S. PATENT DOCUMENTS

| | | | | | |
|---|---|---|---|---|---|
| 1,351,780 | A | * | 9/1920 | Mead | 251/353 |
| 2,116,087 | A | * | 5/1938 | Wahl | 137/234.5 |
| 3,800,825 | A | * | 4/1974 | Zoll | 137/544 |
| 4,006,716 | A | * | 2/1977 | Cross | 119/72.5 |
| 4,017,062 | A | * | 4/1977 | Zwirner | 267/166 |
| 4,062,517 | A | * | 12/1977 | Jones | 251/322 |
| 4,234,056 | A | * | 11/1980 | Farrell | 184/105.3 |
| 2005/0016599 | A1 | | 1/2005 | Talaski | |
| 2006/0272711 | A1 | | 12/2006 | Talaski | |
| 2008/0190492 | A1 | | 8/2008 | Fuchs et al. | |

FOREIGN PATENT DOCUMENTS

| | | |
|---|---|---|
| DE | 26 57 669 | 6/1978 |
| DE | 44 31 130 | 3/1996 |
| DE | 199 27 197 | 12/2000 |
| EP | 1 500 855 | 1/2005 |
| FR | 1 560 656 | 3/1969 |
| JP | 2003-515698 | 5/2003 |
| JP | 2006-207451 | 8/2006 |
| WO | 2006/125690 | 11/2006 |

OTHER PUBLICATIONS

European Search Report dated Jan. 21, 2009.
Japan Office Action dated Oct. 21, 2011.

* cited by examiner

*Primary Examiner* — Kevin Lee
*Assistant Examiner* — Macade Brown
(74) *Attorney, Agent, or Firm* — Mark H. Svoboda

(57) ABSTRACT

A valve assembly for use in a fuel pump comprises a body member with a valve aperture, a valve member movable within the body member and adapted to close the valve aperture, and a biasing arrangement having a first part fixed with respect to one of the body member and the valve member and a second part fixed with respect to the other of the body member and the valve member. The biasing arrangement is adapted to bias the valve member to close the valve aperture. The biasing arrangement comprises a helical spring with a first diameter at the first part and a second diameter at the second part. The first diameter of the helical spring is different from the second diameter of the spring. The helical spring is at its first part retained by an interference fit against the member with respect to which it is fixed.

12 Claims, 2 Drawing Sheets

VALVE ASSEMBLY FOR FUEL PUMP

TECHNICAL FIELD

The invention relates to a valve assembly suitable for use in a fuel pump. Embodiments of the valve assembly described are particularly suitable for use in a fuel pump for use in a common rail fuel injection system for supplying high pressure fuel to a compression ignition internal combustion engine.

BACKGROUND TO THE INVENTION

Fuel pumps are employed in a variety of engine systems. Common rail fuel injection systems for compression ignition (diesel) internal combustion engines provide excellent control of all aspects of engine operation and require a pump to act as a source of high pressure fuel. One known common rail fuel pump is of radial pump design and includes three pumping plungers arranged at equi-angularly spaced locations around an engine driven cam. Each plunger is mounted within a plunger bore provided in a pump head mounted to a main pump housing. As the cam is driven in use, the plungers are caused to reciprocate within their bores in a phased, cyclical manner. As the plungers reciprocate, each causes pressurisation of fuel within a pump chamber defined at one end of the associated plunger bore in the pump head. Fuel that is pressurised within the pump chambers is delivered to a common high pressure supply line and, from there, is supplied to a common rail or other accumulator volume, for delivery to the downstream injectors of the common rail fuel system.

Such a fuel pump has an inlet valve for admitting fuel under low pressure and an outlet valve for letting out the pressurised fuel. Both inlet and outlet valves are non-return valves (also known as check valves)—each have a valve member which is a moving element biased by a spring to close a valve aperture.

For the inlet valve, the valve member forms a plunger. One end of the plunger is biased to close the valve aperture. The biasing spring is fixed to the other end of the plunger, the spring extending around the plunger shaft to a seat in the pump body. A spring seat is formed at the second end of the plunger to retain the biasing spring in compression between the two seats. A variety of approaches have been used to fix this spring seat: clipping the spring seat around the plunger shaft; press fitting a spring seat on to the plunger shaft; and welding or screwing the spring seat to the plunger shaft.

For the outlet valve, the valve member is a ball biased to close the valve aperture by the biasing spring. The ball is located in one end of the biasing spring. A spring seat fixed to a body of the valve retains the other end of the biasing spring. The same variety of approaches are used to fix this spring seat as for the inlet valve: clipping the spring seat inside the bore of the valve body; press fitting a spring seat into the valve body; and welding or screwing the spring seat to the valve body.

An example of such an arrangement is shown in WO 2006/125690 A1. This document describes a high pressure pump with an outlet valve in which a spring retainer is inserted into the outlet bore of the pump body and fixed into it by press fitting.

It is an object of the present invention to provide a valve assembly suitable for use in a fuel pump and which avoids or overcomes the limitations of the aforementioned types of valve assembly.

SUMMARY OF THE INVENTION

According to the present invention, there is provided a valve assembly for use in a fuel pump comprising: a body member with a valve aperture; a valve member movable within the body member and adapted to close the valve aperture; and biasing means having a first part fixed with respect to one of the body member and the valve member and a second part fixed with respect to the other of the body member and the valve member, the biasing means being adapted to bias the valve member to close the valve aperture; wherein the biasing means comprises a helical spring with a first diameter at the first part and a second diameter at the second part, wherein the first diameter and the second diameter are different from each other, and wherein the helical spring at either the first part or the second part is retained by an interference fit against the member with respect to which it is fixed.

Such an arrangement provides a valve assembly with fewer parts than in conventional prior art valve assemblies. Such an arrangement may also be beneficial in reducing tolerance requirements for the mounting of the biasing means. The resilience of the spring allows for a significant tolerance in the spring diameter with regard to the diameter of the component that forms the other part of the interference fit. Prior art arrangements, such as the use of spring seats without such resilient properties, will not allow such a significant design tolerance.

Preferably, the first part of the helical spring has a helical pitch throughout.

Advantageously, the first part of the helical spring comprises at least two close wound turns.

It is also preferred that the first part of the helical spring contains a closed loop at an end of the helical spring. This closed loop may be ground to form a flat end surface to the helical spring.

Advantageously, the helical spring comprises a variable diameter section, comprising the first part of the helical spring and in which the diameter of the helical spring varies, and a constant diameter section, comprising the second part of the helical spring and in which the diameter of the helical spring is substantially constant. Substantially the whole of the variable diameter section may be close wound.

In a first arrangement, the first diameter is larger than the second diameter, and wherein the first part of the helical spring forms an interference fit against an inner wall of the body member. Furthermore, in this arrangement the second part of the helical spring may include a free end that abuts the valve member.

In a second arrangement, the first diameter is smaller than the second diameter, and wherein the first part of the helical spring forms an interference fit against an outer surface of the valve member. In this arrangement, the helical spring is received over the valve member and the second part of the helical spring forms an interference it with an annular groove on the body member.

In one aspect of the invention, a fuel pump comprises an inlet valve assembly and an outlet valve assembly, wherein one or both of the inlet valve assembly and the outlet valve assembly is a valve assembly as described above.

In one form of fuel pump according to this aspect of the invention, the inlet valve assembly is a valve assembly as claimed in the second arrangement of valve assembly, and wherein the outlet valve assembly is a valve assembly as claimed in the first arrangement of valve assembly.

BRIEF DESCRIPTION OF THE DRAWINGS

The invention will now be described, by way of example only, by reference to the following drawings in which.

DETAILED DESCRIPTION OF PREFERRED EMBODIMENTS

Figure 3:
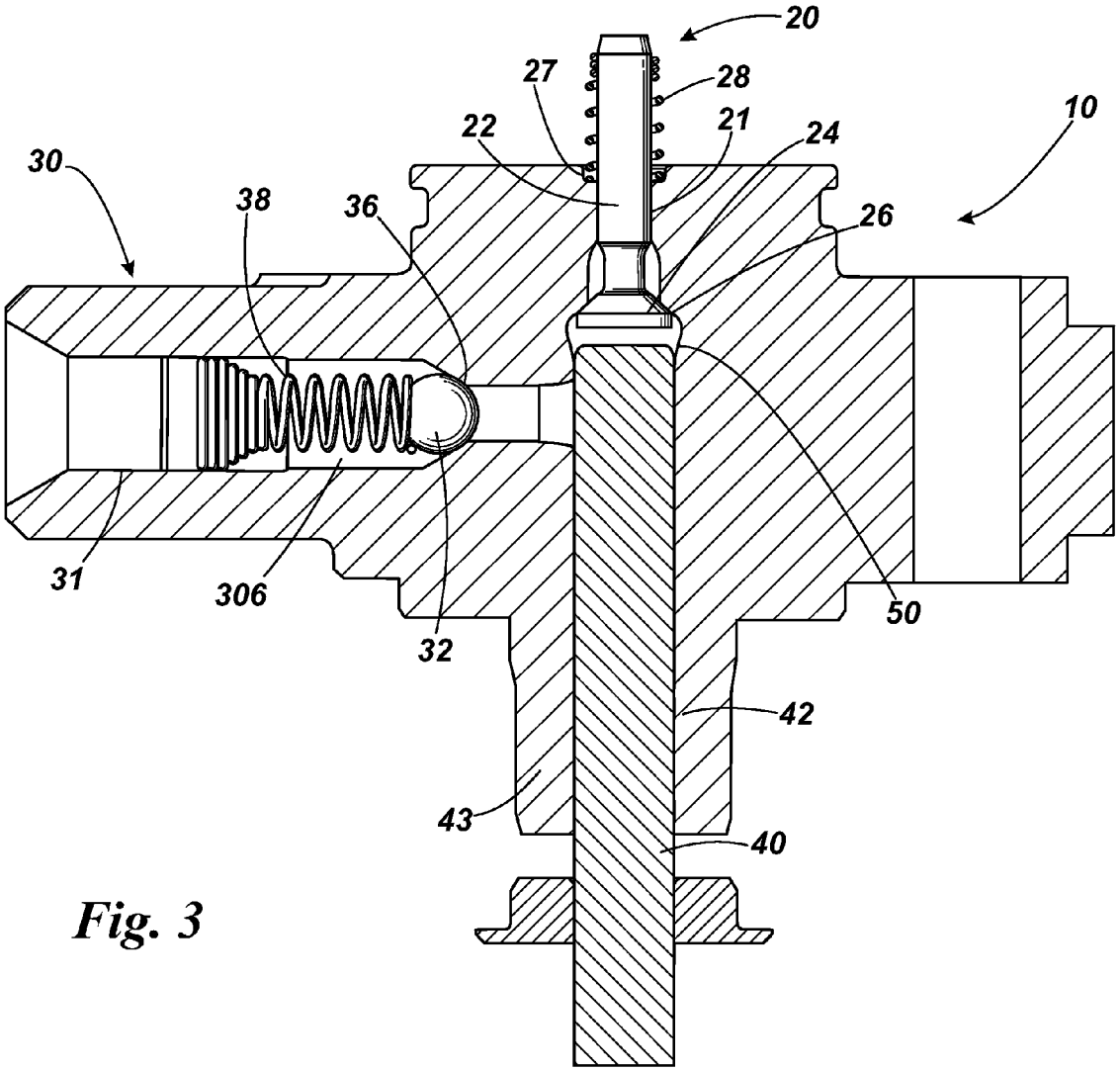
FIG. 3 is a cut-away view of the fuel pump assembly comprising the valve assemblies of the first and second embodiments of the invention.

Referring to FIG. 3, a fuel pump assembly 10 comprises an inlet valve 20 to allow low pressure fuel into the fuel pump assembly 10 and an outlet valve 30 to allow high pressure fuel to leave the fuel pump assembly 10. The fuel is pressurised in a fuel chamber 50 by a pumping plunger 40 reciprocating in a bore 42 provided in a pump body 43. This plunger may, for example, be driven by a cam (not shown) and is used to pressurise the fuel.

The inlet valve 20 comprises a valve member 22 in the form of a plunger. This valve member 22 reciprocates in an inlet bore 21 of the pump body 43. The inlet bore 21 joins the fuel chamber 50 at a valve aperture 26. A valve closure end 24 of the valve member 22 is biased to close the valve aperture 26 by a first biasing arrangement in the form of a spring 28. The biasing spring 28 works in compression, one end located in an annular groove 27 on the pump body 43 and the other end fixed to a part of the valve member 22 remote from the valve aperture 26. The biasing spring 28 varies in diameter along its length—it has a first, smaller, diameter at the end remote from the valve aperture 26, and at this end forms an interference fit around the valve member 22. It should be noted that the term 'interference fit' is used here to mean a fit between two mating parts whose tolerances are such that one part will have a slightly larger dimension than that of the part into which it will be inserted such that the fastening between the two parts which is achieved by friction after the parts are pushed together.

The outlet valve 30 comprises a valve member 32 in the form of a ball. This ball 32 is located in an outlet bore 31 of the pump body 43, the outlet bore 31 joining the fuel chamber 50 at a valve aperture 36. The ball 32 is biased to close the valve aperture 36 by a second biasing arrangement, also in the form of a spring 38. The biasing spring 38 works in compression, one end located around the ball 32 and the other end fixed to a part of the outlet bore 31 remote from the valve aperture 36. The biasing spring 38 varies in diameter along its length—it has a first, larger, diameter at the end remote from the valve aperture 36, and at this end forms an interference fit with the inner surface of the outlet bore 31.

Both the inlet valve 20 and the outlet valve 30 are non-return valves, sometimes alternatively referred to in the art as check valves. Each valve is biased so that it will only open at a distinct opening pressure. The opening pressure for the inlet valve 20 is lower than the opening pressure for the outlet valve 30. The fuel pump 10 works in the following way. When the plunger 40 moves down, it expands the size of the fuel chamber 50 and lowers the pressure in it. When the pressure is sufficiently low, the difference in pressure between the fuel inlet pressure and the fuel chamber pressure becomes sufficient for the inlet valve 20 to open and for fuel to be admitted into the fuel chamber 50. When the fuel chamber 50 fills and the plunger 40 starts to move upwards, the pressure in the fuel chamber 50 increases. When the inlet fuel pressure no longer exceeds the fuel chamber pressure sufficiently to hold the inlet valve 20 open, the inlet valve 20 closes. Throughout these stages, the outlet valve 30 has been closed as there has not been sufficient fuel chamber pressure to open it. As the plunger 40 continues to move upwards in the bore 42, the pressure in the fuel chamber 50 rises to the point where it is sufficient to open the outlet valve 30. When the outlet valve 30 opens, pressurised fuel passes out through the outlet until the fuel chamber pressure drops to the point when the outlet valve 30 closes again. The cycle described above then starts again and repeats.

The inlet valve 20 will now be described in more detail with reference to FIG. 1, which provides a first embodiment of a valve assembly according to the invention. The biasing spring 28 is a helical spring that varies in diameter along its length. The main section 206 of the spring 28 is in the form of a conventional cylindrical helical spring. The free end of this main section 206 is located in the groove 27 in the pump body 43 which surrounds the valve member 22. At the other end of this main section 206, the free diameter of the spring 28 reduces to less than the diameter of the valve member 22. The spring 28 is put in place by pressing it over the narrow end of the valve member 22 (the valve member 22 ends in a tapered section 208, making it easier to carry out this process effectively) and is forced to a position sufficient to provide the necessary biasing force on the valve member 24. The end of spring 28 is closed and ground to form a flat end surface 212—this allows force to be applied evenly in positioning of the spring 28, enabling the spring to be accurately positioned.

At the reduced diameter end 202 of the spring 28, the inner surface 204 of the spring 28 forms an interference fit with the outer surface of the valve member 22. At the very end, the spring 28 forms a closed loop. To provide an effective interference fit, at least two turns of the spring 28 are in contact with the outer surface of the valve member 22. This provides rigidity to the reduced diameter end 202 of the spring 28, and the number of turns may be further increased if greater rigidity is required, for example for a significantly heavier duty valve.

Figure 1:
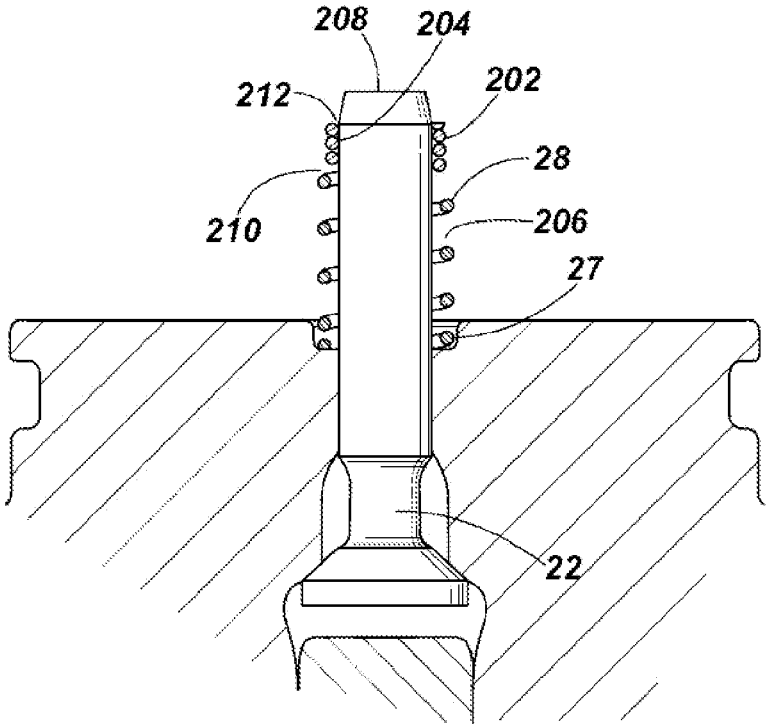
FIG. 1 is a cut-away view of the valve assembly of a first embodiment of the present invention.

As shown in FIG. 1, the reduced diameter end 202 of the spring and a transitional zone 210 of the spring (between the reduced diameter end 202 and the main section 206) are both close wound, with one turn of the spring adjacent to and touching the next turn. For the transitional zone 210, this close winding is desirable to minimize stress in the transitional zone (this may be particularly significant for heavier duty valves). For the reduced diameter end 202, the close winding further increases the rigidity of the spring and hence improves the interference fit with the valve member 22. Where both the reduced diameter end 202 and the transitional zone 210 are close wound, the only working turns of the spring 28 in compression are those in the main section 206 of the spring. This has the benefit that the properties of the spring 28 in compression will be similar to those of a conventional cylindrical spring of the length of the main section 206—in particular, there will not be the significant non-linearity that would be found in a spring of variable diameter that was not close wound—so the performance of the spring will be easier to predict and model.

The outlet valve 30 will now be described in more detail with reference to FIG. 2, which provides a second embodiment of a valve assembly according to the invention. The biasing spring 38 is a helical spring that varies in diameter along its length. The main section 306 of the spring 38 is in the form of a conventional cylindrical helical spring. The free end of this main section 306 locates against the ball 32 that the spring 38 biases to close the aperture 36. At the other end of this main section 306, the free diameter of the spring 38 increases to greater than the diameter of the outlet bore 31. The spring is put in place by pressing it into the outlet bore 31 and forcing it to a position sufficient to provide the necessary biasing force on the ball 32. The end of the spring 38 is closed and ground to form a flat end surface 312—this allows force to be applied evenly in positioning of the spring 38, enabling the spring to be accurately positioned.

At the increased diameter end 302 of the spring 38, the outer surface 304 of the spring 38 forms an interference fit with the inner surface of the outlet bore 31. To provide an effective interference fit, at least two turns of the spring 38 are in contact with the outer surface of the outlet bore 31. This provides rigidity to the increased diameter end 302 of the spring 38, and the number of turns may be further increased if greater rigidity is required, for example for a significantly heavier duty valve.

Figure 2:
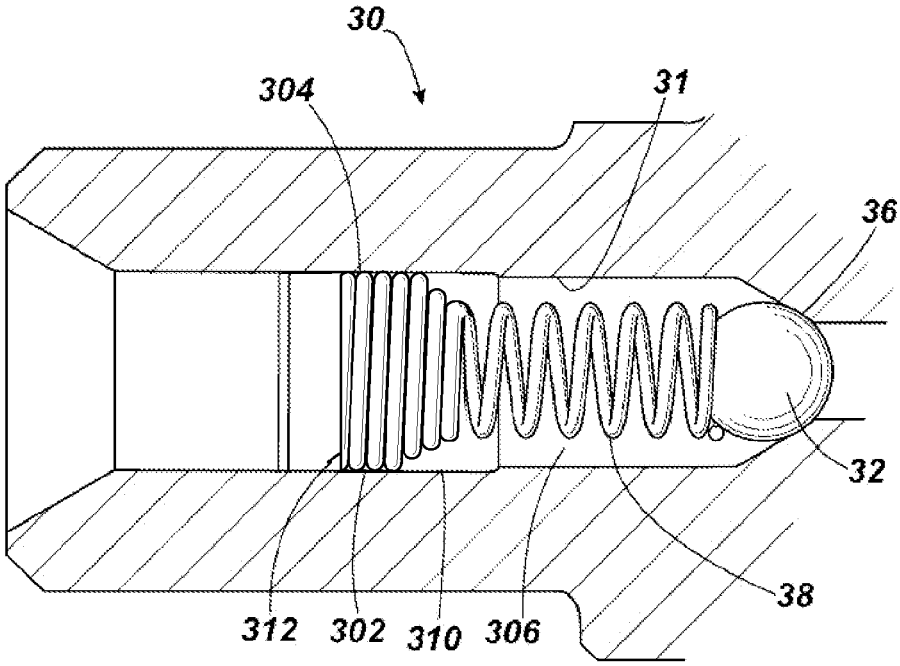
FIG. 2 is a cut-away view of the valve assembly of a first embodiment of the present invention.

As shown in FIG. 2, the increased diameter end 302 of the spring 38 and a transitional zone 310 of the spring (between the increased diameter end 302 and the main section 306) are both close wound, with one turn of the spring adjacent to and touching the next turn. For the transitional zone 310, this close winding is desirable to minimize stress in the transitional zone (this may be particularly significant for heavier duty valves). For the increased diameter end 302, the close winding further increases the rigidity of the spring and hence improves the interference fit with the outlet bore 31. This issue is more significant for the outlet valve 30 than for the inlet valve 20 in the fuel pump of FIG. 3, as two factors can increase the requirements on the interference fit and the transitional zone for the outlet valve 30 relative to the inlet valve 20. One is that the diameter of the spring 38 on the outlet valve 30 is greater at the interference fit, whereas the diameter of the spring 28 on the inlet valve 20 is less at the interference fit. If the spring were to support the same load, then in outlet valve 30 the turns of the spring (or coils) by the interference fit would have a higher stress, with consequent modification of the spring rate. The other is that the elements of the outlet valve 30 are exposed to higher pressures (at high pressures the valve is forced open), whereas the elements of the inlet valve 20 are not (where there is a high pressure in the fuel chamber 50, the inlet valve is forced to close). In the particular embodiment illustrated, the change of diameter is relatively large on the outlet valve spring 38 relative to the inlet valve spring 28, so a more closely wound transition will improve alignment.

These and other valve assemblies according to embodiments of the invention can be used in other fuel pump assemblies, and in assemblies for other forms of pump.

The invention claimed is:

1. A valve assembly for use in a fuel pump comprising:

a rigid body member with a valve aperture;

a valve member movable within the body member and adapted to close the valve aperture;

a biasing arrangement having a first part fixed with respect to one of the body member and the valve member and a second part fixed with respect to the other of the body member and the valve member, the biasing arrangement being adapted to bias the valve member to close the valve aperture;

wherein the biasing arrangement comprises a helical spring with a first diameter at the first part and a second diameter at the second part, wherein the first diameter and the second diameter are different from each other, and wherein the helical spring is at the first part thereof retained by an interference fit against a constant diameter portion of the one of the body member and the valve member with respect to which it is fixed.

2. A valve assembly as claimed in claim 1, wherein the first part of the helical spring has a helical pitch throughout.

3. A valve assembly as claimed in claim 1, wherein the first part of the helical spring comprises at least two close wound turns.

4. A valve assembly as claimed in claim 1, wherein the first part of the helical spring contains a closed loop at an end of the helical spring.

5. A valve assembly as claimed in claim 4, wherein the closed loop is ground to form a flat end surface to the helical spring.

6. A valve assembly as claimed in claim 1, wherein the first diameter is smaller than the second diameter, and wherein the first part of the helical spring forms an interference fit against an outer surface of the valve member.

7. A fuel pump comprising an inlet valve assembly and an outlet valve assembly, wherein one or both of the inlet valve assembly and the outlet valve assembly is a valve assembly as claimed in claim 1.

8. A valve assembly for use in a fuel pump comprising:

a rigid body member with a valve aperture;

a valve member movable within the body member and adapted to close the valve aperture;

a biasing arrangement having a first part fixed with respect to one of the body member and the valve member and a second part fixed with respect to the other of the body member and the valve member, the biasing arrangement being adapted to bias the valve member to close the valve aperture;

wherein the biasing arrangement comprises a helical spring with a first diameter at the first part and a second diameter at the second part, wherein the first diameter and the second diameter are different from each other, and wherein the helical spring is at the first part thereof retained by an interference fit against a constant diameter portion of the one of the body member and the valve member with respect to which it is fixed, wherein the helical spring comprises a variable diameter section comprising the first part of the helical spring, in which the diameter of the helical spring varies, and a constant diameter section comprising the second part of the helical spring, in which the diameter of the helical spring is substantially constant.

9. A valve assembly as claimed in claim 8, wherein substantially the whole of the variable diameter section is close wound.

10. A valve assembly for use in a fuel pump comprising:

a rigid body member with a valve aperture;

a valve member movable within the body member and adapted to close the valve aperture;

a biasing arrangement having a first part fixed with respect to one of the body member and the valve member and a second part fixed with respect to the other of the body member and the valve member, the biasing arrangement being adapted to bias the valve member to close the valve aperture;

wherein the biasing arrangement comprises a helical spring with a first diameter at the first part and a second diameter at the second part, wherein the first diameter and the second diameter are different from each other, and wherein the helical spring is at the first part thereof retained by an interference fit against a constant diameter portion of the one of the body member and the valve member with respect to which it is fixed, wherein the first diameter is larger than the second diameter, and wherein the first part of the helical spring forms an interference fit against an inner wall of the body member.

11. A valve assembly as claimed in claim 10, wherein the second part of the helical spring includes a free end that abuts the valve member.

12. A valve assembly for use in a fuel pump comprising:

a rigid body member with a valve aperture;

a valve member movable within the body member and adapted to close the valve aperture;

a biasing arrangement having a first part fixed with respect to one of the body member and the valve member and a second part fixed with respect to the other of the body member and the valve member, the biasing arrangement being adapted to bias the valve member to close the valve aperture;

wherein the biasing arrangement comprises a helical spring with a first diameter at the first part and a second diameter at the second part, wherein the first diameter and the second diameter are different from each other, and wherein the helical spring is at the first part thereof retained by an interference fit against a constant diameter portion of the one of the body member and the valve member with respect to which it is fixed, wherein the first diameter is smaller than the second diameter, wherein the first part of the helical spring forms an interference fit against an outer surface of the valve member, and wherein the helical spring is received over the valve member and the second part of the helical spring forms an interference fit with an annular groove provided on the body member.

* * * * *